United States Patent [19]

Morane

[11] Patent Number: 4,471,874

[45] Date of Patent: Sep. 18, 1984

[54] MAKE-UP DEVICE

[75] Inventor: Bruno P. Morane, Neuilly, France

[73] Assignee: L'Oreal, Paris, France

[21] Appl. No.: 445,540

[22] Filed: Nov. 30, 1982

[30] Foreign Application Priority Data

Dec. 3, 1981 [FR] France ..... 81 22648
Nov. 4, 1982 [FR] France ..... 82 18510

[51] Int. Cl.[3] ..... A45D 40/20; B65D 85/24

[52] U.S. Cl. ..... 206/581; 206/380; 206/385; 206/823; 220/339; 132/88.7

[58] Field of Search ..... 206/95, 86, 581, 379, 206/472, 473, 474, 380, 382, 383, 820, 385, 823, 118; 132/79 C, 88.7, 90, DIG. 3; 220/339

[56] References Cited

U.S. PATENT DOCUMENTS

| | | | |
|---|---|---|---|
| 791,638 | 6/1905 | Metzger | 132/90 X |
| 1,819,451 | 8/1931 | Wissig | 206/382 |
| 1,894,727 | 1/1933 | Benner | 206/385 |
| 2,042,584 | 6/1936 | Bustamante | 206/385 |
| 2,288,386 | 6/1942 | Belden | 206/823 |
| 2,454,718 | 11/1948 | Russo | 206/385 |
| 2,477,194 | 7/1949 | Millard | 206/380 |
| 2,901,100 | 8/1959 | Mueller et al. | 206/485 |
| 3,256,892 | 6/1966 | Esposito, Jr. | 220/339 |
| 3,438,486 | 4/1969 | Pinkas | 206/450 |
| 3,567,013 | 3/1971 | Tannenbaum | 220/339 |

FOREIGN PATENT DOCUMENTS

| | | | |
|---|---|---|---|
| 961452 | 1/1975 | Canada | 206/380 |
| 935497 | 11/1955 | Fed. Rep. of Germany | 206/380 |
| 398562 | 9/1933 | United Kingdom | 206/385 |
| 1407399 | 9/1975 | United Kingdom | 206/380 |

*Primary Examiner*—William T. Dixson, Jr.
*Assistant Examiner*—Brenda J. Ehrhardt
*Attorney, Agent, or Firm*—Cushman, Darby & Cushman

[57] ABSTRACT

A make-up applicator comprises a wallet in the shape of a book of matches, having an array of tear off sticks with tips coated with eye shadow or lip rouge, and a closure flap adapted to fold over the sticks to close the wallet. A relief formation prevents the closure flap from contacting the coated tips of the sticks when the wallet is closed.

26 Claims, 8 Drawing Figures

MAKE-UP DEVICE

DESCRIPTION

The present invention concerns a make-up device, in particular for the lips and eyelids.

It is known that the device presently used for lip make-up consists of a lipstick applicator having a stick of lipstick composition, i.e. lip rouge, disposed within a cylindrical casing closed by a cap, a mechanism being provided to cause the stick of lipstick composition to emerge from its casing and then to return it inside the casing after use in making up.

Such a device, although in general use, suffers from a certain number of drawbacks: firstly, it has a cylindrical shape although it would in many cases be desirable for it to have a flap shape, especially when it is to be carried within the pocket of a garment or of a bag; secondly, the lipstick applicator is used for making up many times so that the user does not always readily know the appropriate quantity to be applied to the lips to obtain the best make-up; it would therefore be desirable to devise a device allowing the user to apply first the right quantity of lipstick composition, without risk of error, which is necessary for one application so that making up is effected with neither an undue quantity of lipstick composition nor too small a quantity. Thirdly, the lipstick applicator of the known type is used for numerous applications, so much so that it would be desirable, with a view to improving hygiene, to provide an applicator which can be used once only and is disposable after use without the cost of such an applicator being prohibitive in comparison with the cost of a make-up effected by means of a lipstick applicator of the conventional type.

To attain the objects aimed at above, the invention proposes to make a make-up device resembling a book of matches, in that each "matchstick" is in fact a make-up stick whose end carries a quantity of lipstick composition. Such a wallet of make-up sticks has a flat shape and may therefore be used in the pocket of a garment without producing an unsightly bulging. It can be easily opened or closed, in the same way as a book of matches. Each make-up stick carries first the right quantity of lipstick necessary for one make-up application so that the user is sure of applying the appropriate quantity of lipstick composition. Each make-up stick only serves for one application and is disposed of after use, which is advantageous as far as hygiene is concerned.

Moreover, the advantage of the lip make-up device according to the invention, lies in its simplicity of manufacture:

It may be constituted by two units of plastic material obtained by moulding or hot forming of a suitably cut sheet, the first unit forming the wallet properly so-called and the second unit being composed of a row of make-up sticks, connected by means of a tear off fastener to a common base coming to be catch engaged on the wallet. The deposit of the lipstick on the make-up sticks may be subjected to intensive mechanisation, since it consists in immersing the row of lipsticks fixed to their common base into a liquid lipstick compound, then letting them dry, this unit then being catch engaged on the wallet.

The manufacture of the make-up device may be simplified still further by making the wallet and the make-up sticks connected to the base integrally, the unit constituted by the base and the adjoining make-up sticks and which is extended into the wallet, being capable of being folded over on the flap of the wallet intended to support it, after the coating of the ends of the make-up sticks. In this case too, depositing the make-up product does not cause any difficulty and may be entirely mechanised.

The object of the present invention is therefore a new industrial product constituted by a make-up device for the lips and eyelids in particular, characterised in that it comprises a wallet enclosing a unit comprising a multiplicity of make-up sticks, one of whose ends is covered by the make-up product and whose other end is connected by means of a tear off fastener to a common base, serving to fix the said unit within the wallet.

It is preferable for the ends of the make-up sticks which are on the opposite side from their common base to be covered by a lipstick compound or eyeshadow.

The make-up device according to the invention does advantageously comprise a single row of make-up sticks regularly interspaced from each other.

In accordance with a first embodiment of the make-up device according to the invention, the wallet and the unit constituted by the base and the associated make-up sticks are made separately by moulding or hot forming, the said unit being capable of being fixed within the wallet.

The latter is advantageously constituted by a hot formed sheet of plastic material and the above-mentioned unit is preferably made of a moulded plastic material.

The common base of the row of make-up sticks is hollow and comes to be force fitted on an indentation in relief of a complementary shape arranged on the inner side of the wallet.

According to another characteristic of this make-up device, the wallet consists of a hot formed sheet of plastic material comprising two end flaps connected by fold lines to an intermediate flap of a smaller dimension. One of the above-mentioned end flaps of the wallet is intended to carry the unit formed by the row of make-up sticks and their common base, while the other end flap is provided with a tongue intended to engage within a slit provided for this purpose in the base of the row of make-up sticks, for closing the wallet.

According to another characteristic of this make-up device, the flap of the wallet carrying the unit formed by the row of make-up sticks and their common base, is provided with indentations forming reliefs on its inner side, these reliefs being used for fixing each of the make-up sticks within the wallet. A covering sheet is fixed, for instance by bonding on the back of the flap of the wallet carrying this unit. It serves to conceal the hollows formed by the indentations on the back of the flap in question.

The reliefs arranged on the wallet to ensure the fixing of the row of make-up sticks comprise firstly, at least a small crenellated bar between the projections of which, the make-up sticks are inserted and secondly, ribs perpendicular to the crenellated bar (or bars) of lesser height than the projections of the bar (or bars) and situated in line with the said projections. In the case where provision is made for two crenellated bars, the latter are substantially parallel and the projections of the two bars have substantially the same height and are interconnected by a rectilinear rib of leser height, the above-mentioned ribs extending beyond the crenellated bar disposed near the flap forming the fold over of the wallet.

Moreover, the height of the said projections measured at the bottom of the notches arranged between the projections is greater than the thickness of the make-up sticks so that the end flap which is folded over against the row of make-up sticks when the wallet is being closed, may bear against the projections of the crenellated bar (or bars) without coming into contact with the make-up sticks and in particular, their end which is covered by the make-up product.

According to another characteristic of this make-up device, the deposit of the make-up product on the row of the make-up sticks joined to their common base is effected before this unit is fixed within the wallet, by immersion of the make-up sticks in a compound of the make-up product, followed by drying or gelling.

According to a second embodiment of the make-up device according to the invention, the said base and the associated make-up sticks are formed integrally with the said wallet.

It is then preferable for the make-up device to comprise a main flap intended to accommodate the make-up sticks and their base whose opposite two transverse edges are respectively connected to the said base of the make-up sticks and to an end flap intended to form the fold over of the wallet, the said base and the said end flap being capable of coming to be folded successively on to the main flap.

According to this second embodiment of the invention, means are provided on the one hand, for fixing the base in a folded back position to the main flap and, on the other hand for fixing the end flap forming the make-up sticks and their base, on the unit formed by the main flap.

As with the first embodiment, the main flap of the wallet carrying the unit formed by the row of make-up sticks and their common base, is provided with reliefs on its inner side, these reliefs being used for holding each of the make-up sticks within the wallet.

In accordance with a first variant of this second embodiment, the single piece forming the make-up device is made of a plastic material obtained by moulding: the base of the make-up sticks is preferably constituted by a flap connected to the main flap and folded back at right angles along its opposite end edge so as to form a wall carrying on its outside side, the row of make-up sticks by means of tear off fasteners; the flap forming the base of the make-up sticks and the flap forming the fold over are connected to the main flap by means of flaps of smaller dimensions, fold lines separating all these flaps, the two intermediate flaps comprising, moreover, a centre fold line; the means of fixing the base of the make-up sticks to the main flap consist, for instance, of a stud carried by the inner side of the said flap near its connecting zone with the said base, the said stud being capable of being force fitted in an opening provided in a wall element of the base which is perpendicular to the wall carrying the make-up sticks, situated opposite the wall of the base connected to the main flap and joined to the said wall and to that which is folded at right angles; the means of fixing the flap forming the fold over with the rest of the make-up device in a folded over position, consist of a stud carried internally by the flap forming the fold over, and being capable of penetrating into an opening cut in the wall of the base joined to the main flap with a tight fit; the ribs and the crenellated bar (or bars) forming the securing means of the make-up sticks as well as the studs, are elements obtained by moulding.

In accordance with a second variant of the second embodiment, the single piece forming the make-up device is made from a sheet of plastic material which is suitably cut and hot formed; the base of the make-up sticks is preferably constituted by a flap connected to the main flap via a fold line and carries an indentation forming an elongated relief parallel to the said fold line, this relief being capable of coming to be force fitted on an indentation in relief of a complementary shape arranged on the inner side of the main flap; the ribs and the crenellated bar (or bars) constituting the securing means for the make-up sticks are also formed by indentations forming reliefs on the inner side of the main flap, a covering sheet is fixed, for instance by bonding, on the back of the main flap, so as to conceal the hollows formed by the indentations on the back of the flap in question; the flap forming the fold over is provided with a tongue intended to engage within a slit provided for this purpose in the base of the row of make-up sticks when the flap is closed (this mode of closing may also be provided in the case where the make-up device is obtained by moulding), the flap forming the fold over and the main flap are connected via fold lines to an intermediate flap with a smaller dimension.

In order that the present invention may more readily be understood there will now be described merely by way of example, two embodiments shown in the accompanying drawings, in which:

FIGS. 1 to 4 show a lip make-up device according to the invention, designated by 1 in its entirety, in the form of a book of matches.

Figure 1:
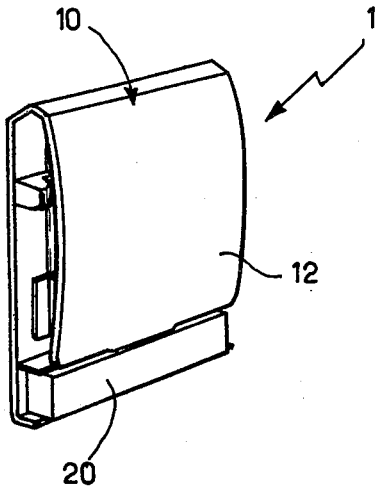
FIG. 1 is a view in perspective of a first embodiment of a make-up device for the lips according to the invention, the wallet of the said device being closed.
Figure 2:
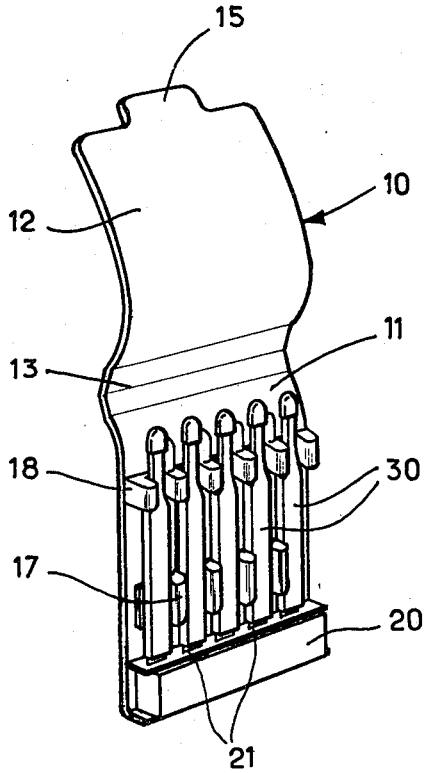
FIG. 2 is a perspective view of the device of FIG. 1, with the wallet open.
Figure 3:
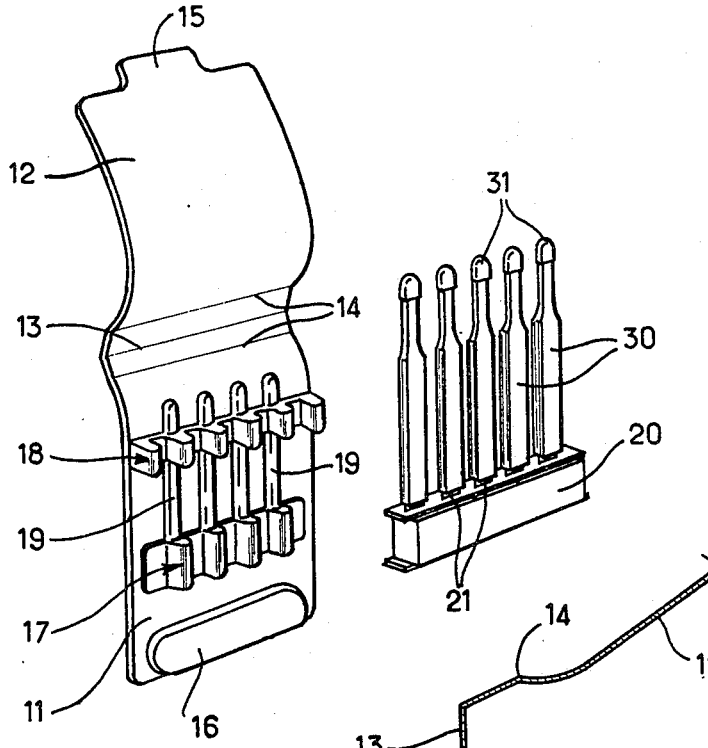
FIG. 3 is an exploded perspective view of the device of FIGS. 1 and 2 showing, on the one hand, the open wallet and, on the other hand, the make-up sticks and their common base before the catch-engagement of the said base within the wallet.

It is, essentially, composed of two elements namely, on the one hand, a wallet 10, and on the other hand, a unit comprising a base 20 and adjoining make-up sticks 30. The unit formed by base 20 and the make-up sticks 30, is made of a moulded plastic material.

The base 20 is hollow; it has a trough shape and, on one of the longitudinal walls thereof, is a row of five make-up sticks 30 connected together by means of a reduced wall zone 21. Each of the reduced wall zones 21 constitutes a tear off fastener allowing a make-up stick 30 to be detached from its base 20.

The make-up sticks 30 substantially have the appearance and dimensions of the usual type of matches contained in a match book or wallet. At the end opposite the base 20, they comprise a reduced part 30*a* whose end 31 is impregnated by lipstick composition.

To impregnate the end 31 of the make-up sticks 30, they are disposed with their base 20 on a rail capable of accommodating a very large number of such make-up stick sets. The rail is then inverted and the make-up sticks 30 are immersed in a lipstick composition and then dried, or cooled for gelling. When this operation is complete, each set of make-up sticks 30 is catch-engaged by means of its base 20 within a wallet 10.

Figure 4:
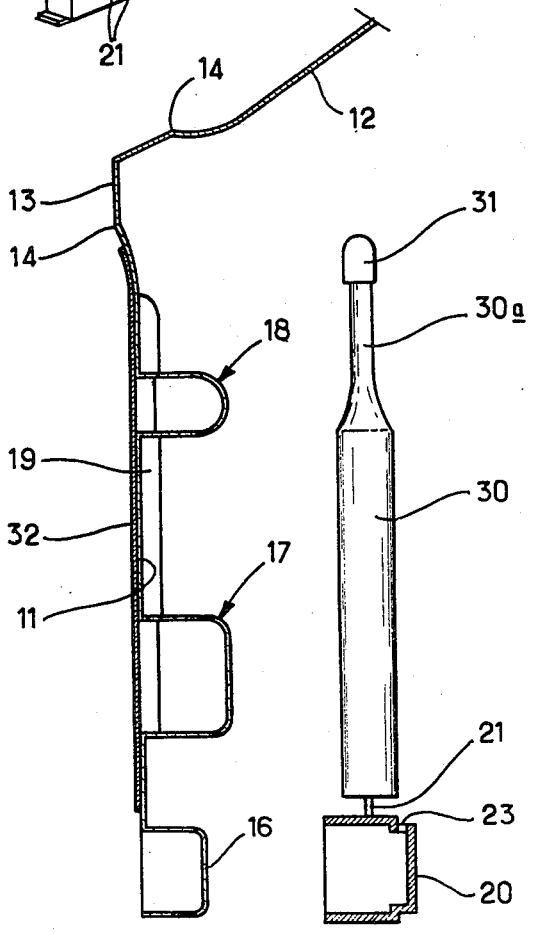
FIG. 4 is a cross-section of the open wallet and of the base of the make-up sticks, before the base is catch-engaged within the wallet.

The wallet 10 consists of a sheet of a hot-formed plastic material comprising two main flaps 11, 12 connected by way of fold lines 14 to an intermediate flap 13 of a smaller dimension. On flap 11, there is fixed a base 20 of the make-up sticks 30. The flap 12 terminates in a tongue 15 which, when flap 12 is folded over against flap 11 within a slit 23 of base 20 (FIG. 4), engages to ensure the closure of wallet 10.

At the back of flap 11 of the wallet, there is arranged a series of indentations forming relief ribs on the inner side of the flap. Thus the flap 11 comprises, near its end edge and on its inside, an indentation 16 in relief of a shape complementary to the hollow base 20 for receiving closely fitted thereon the hollow base 20 to fixing the make-up sticks 30 within the wallet 10.

The inside of flap 11 of the wallet is also provided with other relief indentations for holding the make-up sticks 30 within wallet 10 and also to prevent the walls of wallet 10 from coming into contact with the stick ends 31 which are covered with lipstick composition.

For this purpose, the inside of flap 11 comprises two parallel crenellated bars 17, 18 in relief, extending substantially over all of its width. Each of the make-up sticks 30 is disposed between the projections of the crenellated bars 17, 18 , the projections of the crenellated bar 18 further from the free end of flap 11 are interspaced more closely than those of bar 17, because they accommodate the reduced end 30*a* of the make-up stick 30; the height of the projections of the two crenellated bars 17, 18, measured from the bottom of the notches separating them, is substantially greater than the thickness of the make-up sticks 30 so that, when the wallet is closed, the flap fold 12 acting as a closure flap abuts the projections without coming into contact with the make-up sticks 30. Moreover, each projection of the crenellated bar 17 is connected to a respective projection of the crenellated bar 18 by a rib 19 forming a relief on the inside of the flap 11 of the wallet. The ribs 19 are of a lesser height than the projections of the two crenellated bars 17, 18 and they extend beyond the crenellated bar 18 towards the fold line 14.

With a view to concealing the hollows in the back of flap 11 of the wallet and which are due to the forming of the two crenellated bars 17, 18 and the ribs 19, a cover sheet 32, for instance of aluminium, is fixed by bonding to the back of flap 11 of wallet 10.

One should stress the simplicity of manufacture combined with the ease of use of the wallet of make-up sticks according to the invention. The simplicity of manufacture derives from the fact that it is composed of two moulded separate units which may be joined to each other by a simple fitting operation. The covering of the ends of the row of make-up sticks 30 with a lipstick make-up composition does not present any difficulty and may be entirely mechanised. The ease of use of the make-up device according to the invention is due to its original presentation in the form of a book of matches.

Figure 5:
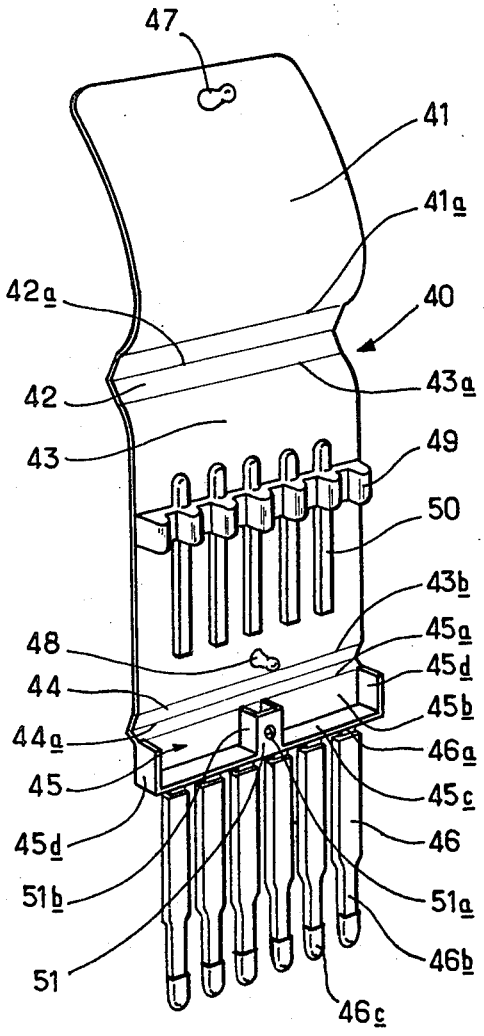
FIG. 5 is a view in perspective of a first variant of a second embodiment of a lip make-up device according to the invention, this device being shown in a completely unfolded position.
Figure 6:
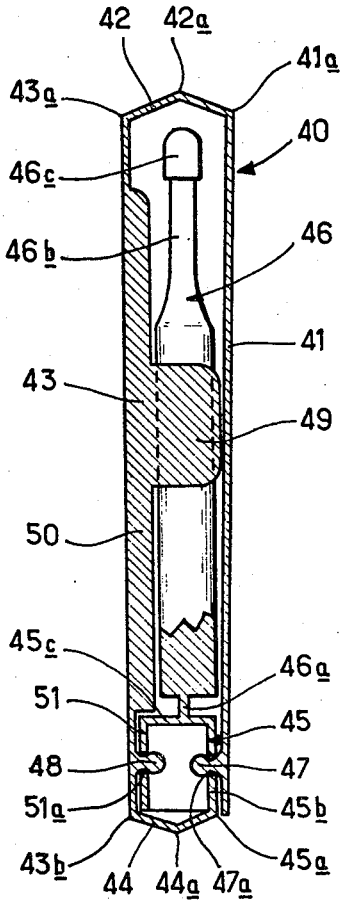
FIG. 6 is a cross-sectional view along the central longitudinal plane of the make-up device of FIG. 5, in a closed configuration.

FIGS. 5 and 6, show another lip make-up device in accordance with the invention, in the form of a book of matches designated 40 in its entirety, this device being made integrally by moulding of plastic material.

When considered in an unfolded configuration shown in FIG. 5, the moulded piece 40 has substantially the shape of an elongated rectangle and comprises, extending across the piece 40 from one transverse edge to the other, (a) a flap 41 intended to form the fold over or closure of the wallet, (b) a smaller flap 42, (c) a flap 43 intended to receive and keep the make-up sticks described below, and (d) a flap 44, also of a small dimension, on the outer longitudinal edge of which is a base 45 for a row of six make-up sticks 46.

The make-up sticks 46 have substantially the appearance and size of matches of the usual type contained in a match book. Each has a reduced wall zone 46*a* connecting it to the common base 45, the zones 46*a* constituting rupturable fasteners allowing them to be detached from their base. At the end opposite from the base, they have a reduced part 46 whose end 46*c* is impregnated with lipstick composition.

The set of elements 41 to 45 constitutes the so-called wallet, the element 45 moreover performing the function of a base for the make-up sticks 46 as first indicated above.

The two main flaps 41 and 43 of the wallet are connected to a first intermediate flap 42 by two fold lines 41*a* and 43*a* respectively, the intermediate flap 42 moreover including a central fold line 42*a*.

Similarly, flap 43 and the base 45 are connected to a further intermediate flap 44 by two fold lines 43*b*, 45*a* respectively. The flap 44 also comprises a centre fold line 44*a*.

The flap 41 comprises, on its inner side near its free transverse edge, a stud 47 which when the said flap 41 is folded against flap 43 is engaged within an opening 47*a* in the base 45.

On the inner side of flap 43, near the fold line 43*b*, is a stud 48 whose function is described below. Moreover, the flap 43 comprises, also on its inner side, reliefs 49, 50 to hold the make-up sticks 46 within the wallet. The relief 49 which extends substantially over the whole width of flap 43 has the shape of a crenellated bar, between the projections of which the bodies of make-up sticks 46 are placed; the height of the projections of the crenellated bar 49, measured at the bottom of the notches separating them, is substantially greater than the thickness of the make-up sticks so that when the wallet is closed the closure flap 41 abuts the projections of bar 49 without coming into contact with the make-up sticks 46. Moreover, perpendicular to the crenellated bar and in line with each of the projections of this bar, are parallel ribs 50 extending over the whole central region of flap 43.

Instead of one crenellated bar two could have been provided as described with reference to FIGS. 1 to 4, the one accommodating the bodies of the make-up sticks 46 and the other at their reduced parts 46*b*.

The base 45 is constituted by a wall 45*b* connected by means of the fold line 45*a* to the second intermediate flap 44, this wall continued by right angle returns at its three free edges which form a front wall 45*c* and two sides 45*d*.

The stud-receiving opening 47*a* is arranged in wall 45*b*. Parallel to this wall 45*b* and connected to its outer edge is a wall element 51 having a central stud-receiving opening 51*a* situated opposite the opening 47*a* and connected to the wall 45b by two sides 51b parallel to sides 45d.

To form this make-up device 40, the unitary component shown in FIG. 5 is moulded. Then a considerable number of such components is disposed on a rail so that the make-up sticks 46 are directed downwardly. The sticks 46 are then immersed in a lipstick composition and then dried, or cooled for gelling. When this operation is complete, the base 45 is folded over onto the flap 43 to allow the lipstick matches to be kept in place, since the stud 48 of the flap 43 is received in opening 51a. Finally, the flap 41 is folded onto flap 43 and is fixed by introducing its stud 47 into the opening 47a of the base 45.

Figure 7:
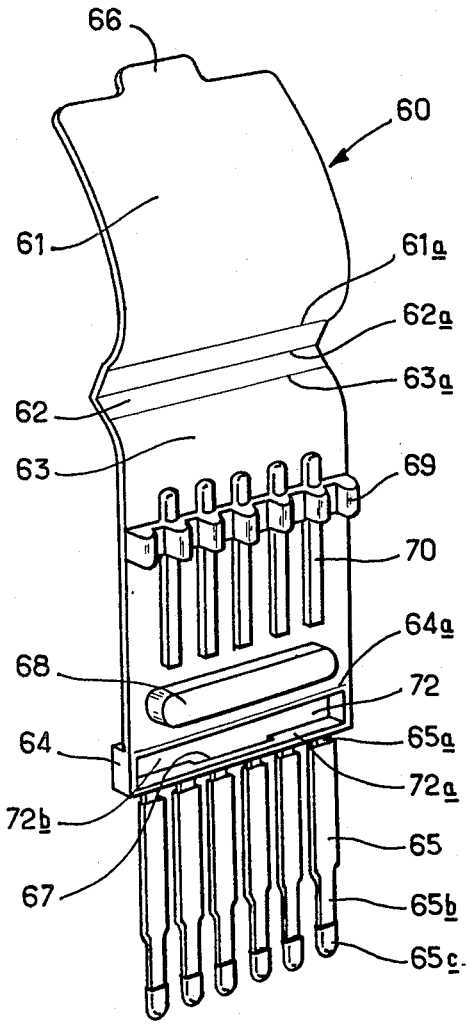
FIGS. 7 and 8 are views similar to FIGS. 5 and 6 respectively of a second variant of this second embodiment.
Figure 8:
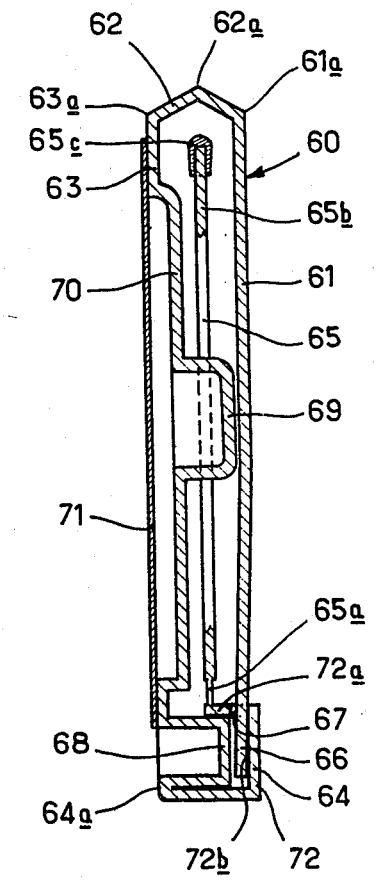

FIGS. 7 and 8, show another lipstick make-up device according to the invention, designated 60 in its entirety, this device being made from a sheet of plastic material having the shape of an elongated rectangle, suitably cut and provided with fold lines and indentations obtained by hot forming, in accordance with the details described below.

This sheet comprises, proceeding from one transverse edge to the other, (a) a flap 61 to form the closure of the wallet (b) a smaller flap 62, (c) a flap 63 intended to accommodate the make-up sticks (described below), and (d) a flap 64, also of a small size, on the outer longitudinal edge of which is connected thereto by way of a reduced wall zone 65a, a row of six make-up sticks 65. Each of the reduced wall zones 65a constitutes a rupturable fastener allowing a make-up stick 65 to be detached from its base 64. At the end opposite from the base 64 each make-up stick 65 comprises a reduced part 65b whose end, 65c, is impregnated with lipstick composition.

The unit comprising flaps 61 to 64 constitutes the so-called wallet, and flap 64 serves as the base for the make-up sticks 65.

The two main flaps 61 and 63 are connected to the intermediate flap 62 by means of two fold lines 61a and 63a, respectively; moreover, the intermediate flap 62 carries a centre fold line 62a. The flaps 63 and 64 are connected via a fold line 64a.

Flap 61 terminates in a tongue 66 which, when the closure flap 61 is folded over against flap 63, becomes engaged within a slit 67 of the base flap 64 to close the wallet.

On the back of flap 63, are indentations forming reliefs on the inside of the flap. Thus the flap 63 comprises, near the fold line 64a and parallel thereto, on its inner side, an indentation in relief 68 of an enlongated shape.

The inner side of flap 63 of the wallet is also provided with other indentations in relief, for holding the make-up sticks 65 within the wallet and thus preventing the walls of the wallet from coming into contact with the stick ends which are covered with lipstick composition.

For this purpose, the inside of flap 63 comprises in relief, a crenellated bar 69, extending substantially over the whole of its width and located in the top half of the flap. Each of the make-up sticks 65 becomes placed between the projections of the crenellated bar 69; the height of the projections of the crenellated bar 69 is, as in the preceding embodiment, such that in the closed position of the wallet the flap 63 does not come into contact with the make-up sticks 65. Moreover, provision is also made for ribs 70, perpendicular to bar 69 and with a lesser height than the latter, forming a relief on the inner side of flap 63 of the wallet.

With a view to concealing the hollows of the indentations which are visible on the back of flap 63 of the wallet, due to the forming of the relief indentation 68 of the crenellated bar 69 as well as ribs 70, a cover sheet 71, for instance of aluminium, is fixed by bonding to the back of flap 63 (as shown in FIG. 8).

The outer side of the flap 64 comprises in relief a trough-shaped recess 72 occupying substantially the whole of the flap 64. The recess 72 is capable of being closely fitted on the relief indentation 68 of flap 63 to ensure the fixing of sticks 65 within the wallet. The slit 67 to receive tongue 66 is arranged in the side wall 72a of recess 72 along its common edge with the bottom wall 72b. The sticks 65 are attached perpendicularly to this wall 72a.

To manufacture this make-up device 60, a sheet of relatively thick and rigid plastic material is provided with suitably contoured cuts for obtaining the tongue 66 and the make-up sticks 65. The sheet is provided with reduced wall zones constituting the fold lines 61a, 62a, 63a, 64a and with the feet 65a of the sticks 65; indentations 68, 69, 70 and 72 are obtained by hot forming. These operations may be entirely automated. Then the coating of the ends of the sticks 65 with lipstick composition is effected as described with reference to the first embodiment of the invention. When this operation is complete, each unit of make-up sticks 65 is catch-engaged within the wallet by folding over flap 64 onto flap 63. Flap 61 is then folded over and held in place by introducing the tongue 66 into opening 67.

It shall be duly understood that the embodiments described above are in no way restrictive and may give rise to any desirable modifications without thereby departing from the scope of the present invention.

I claim:

1. A make-up device consisting of:

(a) a wallet; and (b) a unit enclosed by said wallet and comprising:

(ba) a plurality of make-up sticks each having first and second ends;

(bb) a make-up composition applied to said first ends of the sticks;

(bc) other ends connected by means of a rupturable fastener, a base adapted to serve to support the said sticks;

(bd) means to hold said base to said wallet to support the unit within the wallet; and (be) rupturable connector means releasably holding said second ends of the sticks to said base so that said sticks are disposed within the wallet when the unit is within the wallet, said wallet and said unit constituting separately manufactured elements, said means to hold said base to said unit comprising releasable connector means, said base being hollow and said means to hold the base to said wallet including a raised portion having a shape complementary to the interior shape of said hollow base and having dimensions such that said hollow base forms a tight fit thereon.

2. A device according to claim 1, wherein there is a single row of said make-up sticks.

3. A device according to claim 1, wherein the wallet consists of a sheet of hot formed plastic material comprising first and second end flaps, an intermediate flap smaller than said end flaps and fold lines connecting said intermediate flap to said end flaps.

4. A device according to claim 3, wherein said first end flap of the wallet carries said unit; wherein said second end flap is provided with a tongue; and wherein said base includes means defining a slit to receive said tongue.

5. A device according to claim 3, wherein said first end flap carries said unit; and wherein said second end flap includes external indentation means, and corresponding internal relief formations for supporting each of the make-up sticks within the wallet.

6. A device according to claim 1, wherein the make-up composition is applied to the make-up sticks, prior to fixing of the unit of make-up sticks and common base within the wallet, by immersion of the make-up sticks in the make-up composition, followed by drying or gelling of said composition on the sticks.

7. A device according to claim 5, wherein said internal relief formation comprises, firstly, at least one crenellated bar having spaced projections between which the make-up sticks are inserted and, secondly, ribs which are perpendicular to the or each crenellated bar and of a lesser height than the projections of the or each bar, said projections being separated by notch means; said ribs being in register with the said projections; and said projections having a height measured at the floor of each notch means which is greater than the thickness of the make-up sticks.

8. A device according to claim 5, including a cover sheet fixed by bonding to the back of the main flap so as to conceal the hollows formed by the indentation means on the back of the main flap.

9. A device according to claim 1, wherein said make-up composition is one of a lipstick composition and an eye shadow.

10. A make-up device comprising:

(a) a wallet; and (b) a unit enclosed by said wallet and comprising:

(ba) a plurality of make-up sticks each having first and second ends;

(bb) a make-up composition applied to said first ends of the sticks;

(bc) other ends connected by means of a rupturable fastener, a base adapted to serve to support the said sticks;

(bd) means to hold said base to said wallet to support the unit within the wallet; and (be) rupturable connector means releasably holding said second ends of the sticks to said base to that said sticks are disposed within the wallet when the unit is within the wallet, said wallet and said unit being separately manufactured portions and said means to hold said base to said unit comprising releasable connector means, said base being hollow and said means to hold the base to said wallet including relief formation means of complementary shaped to said hollow base and arranged on said wallet to hold said hollow base as a tight fit thereon; said wallet being made from a sheet of hot formed plastic material comprising first and second end flaps, an intermediate flap smaller than said end flaps and having fold lines connecting said intermediate flap to said end flaps, said first end flap carrying said unit, and said first end flap including external indentation means and corresponding internal relief formations for supporting each of the make-up sticks within the wallet.

11. A make-up device comprising:

(a) a wallet; and (b) a unit enclosed by said wallet and comprising:

(ba) a plurality of make-up sticks each having first and second ends;

(bb) a make-up composition applied to said first ends of the sticks;

(bc) other ends connected by means of a rupturable fastener, a base adapted to serve to support the said sticks;

(bd) means to hold said base to said wallet to support the unit within the wallet; and (be) rupturable connector means releasably holding said second ends of the sticks to said base so that said sticks are disposed within the wallet when the unit is within the wallet, said base and said make-up sticks being formed integrally with said wallet as a unitary component.

12. A device according to claim 11, wherein said wallet comprises a main flap to hold the make-up sticks and their base, and an end flap to close the wallet, said main flap having two opposite transverse edges one of which is connected to said base and the other of said opposite edges connected to said end flap, said base and said end flap being capable of being folded successively on the said main flap.

13. A device according to claim 11 including means for fixing the base in a folded position on said main flap and means for fixing said end flap on the said unit when so fixed.

14. A device according to claim 11, wherein the main flap is provided with internal relief formations for holding each of the make-up sticks within the wallet.

15. A device according to claim 11, wherein said unitary component constituting the make-up unit is formed by moulding of a plastic material.

16. A device according to claim 15, wherein the base is constituted by: a base flap connected to said main flap, a folded right angled return along its opposite end edge; on the outside rupturable fastener means holding the make-up sticks on said base flap; an intermediate flap smaller than said main flap; and means defining fold lines connecting the said base and main flap together.

17. A device according to claim 13, wherein said base comprises first, second and third walls; and wherein said make-up sticks are connected to said first wall of the base and the means for holding said base to the main flap comprise: (a) a stud carried internally of said main flap near its connection to said base, said stud being capable of being forcefitted and (b) means defining an opening to receive said stud, provided in said second wall of the base which is perpendicular to said first wall, said second wall being situated opposite said third wall of the base, said third wall being connected to the main flap, and said first wall being joined to said second and third walls.

18. A device according to claim 13, wherein the means for fixing said end flap to the rest of the make-up device in a folded configuration, consist of a stud carried internally by said end flap, and means defining an opening in said base to receive snugly said stud.

19. A device according to claim 13, wherein said means for fixing the end flap to the rest of the make-up device in a folded position, consists of a tongue of the said end flap and means defining a slit in the base to receive said tongue.

20. A device according to claim 18, including relief formation means for holding the make-up sticks, and wherein said relief formation means, the studs, and the rupturable connector means are obtained by moulding.

21. A device according to claim 11, wherein said unitary component which constitutes the make-up unit is made from a sheet of plastic material which has been suitably cut and hot formed.

22. A device according to claim 21, wherein said base comprises a base flap connected to said main flap via a fold line indentation means on said base flap forming an elongate relief parallel to said fold line; relief formation means internally of the main flap of complementary shape to said elongate relief, and means tightly fitting said elongate relief on said relief formation of complementary shape.

23. A device according to claim 21, including relief means internally of the main flap for holding the make-up sticks.

24. A device according to claim 21, including means defining a slit in said base and a tongue to said end flap for engagement within said slit when the wallet is closed.

25. A device according to claim 12, including an intermediate flap smaller than said end flap, and means defining fold lines connecting said end flap and main flap to said smaller intermediate flap.

26. A device according to claim 11, wherein said make-up composition is applied to the make-up sticks, after said unitary component has been formed by one of moulding and hot forming, by immersion of the said sticks in the make-up composition and then drying or gelling of the composition on the sticks.

* * * * *